US011105172B2

(12) United States Patent
Aga

(10) Patent No.: US 11,105,172 B2
(45) Date of Patent: Aug. 31, 2021

(54) TUBING HANGER INSTALLATION TOOL

(71) Applicant: EQUINOR ENERGY AS, Stavanger (NO)

(72) Inventor: Morten Aga, Bergen (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/626,105

(22) PCT Filed: Jun. 29, 2018

(86) PCT No.: PCT/NO2018/050173
§ 371 (c)(1),
(2) Date: Dec. 23, 2019

(87) PCT Pub. No.: WO2019/004842
PCT Pub. Date: Jan. 3, 2019

(65) Prior Publication Data

US 2020/0208486 A1 Jul. 2, 2020

(30) Foreign Application Priority Data

Jun. 29, 2017 (GB) ..... 1710405

(51) Int. Cl.

| | |
|---|---|
| ***E21B 33/035*** | (2006.01) |
| ***E21B 33/043*** | (2006.01) |
| ***E21B 33/064*** | (2006.01) |
| ***E21B 34/04*** | (2006.01) |
| ***E21B 47/10*** | (2012.01) |

(52) U.S. Cl.
CPC ..... *E21B 33/0355* (2013.01); *E21B 33/043* (2013.01); *E21B 33/064* (2013.01); *E21B 34/04* (2013.01); *E21B 47/10* (2013.01)

(58) Field of Classification Search
CPC .. E21B 33/0355; E21B 33/043; E21B 33/064; E21B 34/04; E21B 34/045; E21B 47/10
See application file for complete search history.

(56) References Cited

U.S. PATENT DOCUMENTS 4,375,239 A * 3/1983 Barrington ..... E21B 33/0355 166/336
5,101,907 A * 4/1992 Schultz ..... E21B 23/04 166/386

(Continued)

FOREIGN PATENT DOCUMENTS

GB 2431965 A * 5/2007 ..... F15B 1/165

OTHER PUBLICATIONS

International Search Report, issued in PCT/NO2018/050173, dated Aug. 27, 2018.

(Continued)

*Primary Examiner* — Matthew R Buck
(74) *Attorney, Agent, or Firm* — Birch, Stewart, Kolasch & Birch LLP

(57) ABSTRACT

A system for hydraulically controlling a subsea device includes a compensator provided within a cavity of a well system, a hydraulic connection between the compensator and the subsea device, a pressure regulator arranged to regulate the hydraulic pressure provided to the subsea device and a ventilation tool for releasing pressure at the subsea device.

16 Claims, 3 Drawing Sheets

(56) References Cited

U.S. PATENT DOCUMENTS

| | | | | |
|---|---|---|---|---|
| 6,125,938 | A * | 10/2000 | Garcia-Soule | E21B 34/045 166/344 |
| 6,343,654 | B1 * | 2/2002 | Brammer | E21B 33/0355 166/338 |
| 6,851,481 | B2 * | 2/2005 | Vinegar | E21B 47/13 166/374 |
| 7,107,766 | B2 * | 9/2006 | Zacche' | A23L 3/0155 60/413 |
| 7,665,527 | B2 * | 2/2010 | Loretz | E21B 23/04 166/373 |
| 8,051,872 | B2 * | 11/2011 | Lenz | E21B 33/0355 137/81.2 |
| 8,839,868 | B2 * | 9/2014 | Scranton | E21B 33/0355 166/360 |
| 9,494,007 | B2 * | 11/2016 | Bourgeau | E21B 33/064 |
| 9,650,856 | B2 * | 5/2017 | Gaude | E21B 34/04 |
| 10,337,277 | B2 * | 7/2019 | van Wijk | E21B 33/064 |
| 2005/0133216 | A1 | 6/2005 | Bartlett | |
| 2005/0217845 | A1 * | 10/2005 | McGuire | E21B 34/045 166/100 |
| 2011/0226482 | A1 * | 9/2011 | Trewhella | E21B 33/038 166/340 |
| 2011/0247799 | A1 | 10/2011 | June et al. | |
| 2013/0175041 | A1 | 7/2013 | Nellessen, Jr. | |
| 2013/0175045 | A1 * | 7/2013 | Rytlewski | E21B 33/0355 166/363 |
| 2017/0152723 | A1 * | 6/2017 | Deacon | E21B 41/0014 |
| 2018/0156005 | A1 * | 6/2018 | Carlsen | E21B 41/0007 |
| 2018/0179847 | A1 * | 6/2018 | Derryberry | E21B 34/045 |

OTHER PUBLICATIONS

United Kingdom Combined Search and Exmination Report, issued in Priority Application No. 1710405.0, dated Nov. 7, 2017.

Written Opinion of the International Searching Authority, issued in PCT/NO2018/050173, dated Aug. 27, 2018.

* cited by examiner

TUBING HANGER INSTALLATION TOOL

The invention relates to a method of subsea well intervention, and in particular to installation of a tubing hanger tool and operation of a tubing hanger installation tool.

Control of subsea tools at a wellhead is challenging due to the distance to a vessel or platform at the sea surface. An umbilical may be used to carry power and control signals from the sea surface to the wellhead. An example of a subsea tool is a tubing hanger running tool. A tubing hanger is a support for a production tubing or casing and is provided in a Christmas tree, a dedicated tubing spool or a wellhead. The tubing hanger may also have openings for hydraulic or electronic control lines, or chemical injection lines. The tubing hanger can also provide a seal for the annulus and production areas beneath the hanger. A tubing hanger running tool is used for installing the tubing hanger and is operated by hydraulic power. The hydraulic power is traditionally included in an umbilical running from a vessel or platform at the sea surface to the tubing hanger running tool.

According to a first aspect of the invention there is provided a system for hydraulically controlling a subsea device, the system comprising a compensator provided within a cavity of a well system, a hydraulic connection between the compensator and the subsea device, a pressure regulator arranged to regulate the hydraulic pressure provided to the subsea device and a ventilation tool for releasing pressure at the subsea device.

The system may further comprise a second pressure regulator for controlling the pressure in the cavity, and optionally the pressure regulator may be provided below a choke line. The cavity may be provided within a blow-out preventer or within an annulus above the blow-out preventer or within an annulus above a tubing hanger. The cavity may be provided below an upper annular valve.

The compensator may be a bladder or a piston. The subsea device is a tubing hanger running tool or a tubing hanger. Alternatively, the subsea device may be a wellhead cleaning tool.

The system may further comprise a flowmeter for determining the amount of fluid which has passed towards the subsea device.

According to a second aspect of the invention, there is provided method of hydraulically controlling a subsea device, the method comprising providing a compensator within a cavity of a well system, providing a hydraulic connection between the compensator and the subsea device, controlling the pressure within the cavity, and regulating hydraulic pressure from the compensator to the subsea device.

The cavity may be provided within a blow-out preventer. Controlling the pressure within the cavity may comprise closing a valve. Regulating hydraulic pressure from the compensator to the subsea device may comprise controlling the pressure to a plurality of outlets towards the subsea device and each of the plurality of outlets may control a function of the subsea device. The method may further comprise measuring the amount of fluid which flows towards the subsea device.

Some embodiments of the invention will now be described by way of example only and with reference to the accompanying drawings, in which.

The inventors have appreciated a need for a local supply of hydraulic power at the wellhead, in particular for the application of a tubing hanger running tool. A cavity in the wellhead system can be used to build up pressure. For example, a cavity in a blow-out preventer or Christmas tree, or an annulus in a tubular above the wellhead can be isolated from their respective outlets such that pressure builds up as a result of fluids entering the cavity without being able to leave the cavity. A compensator is provided within the cavity and connected to a hydraulic line such that the pressure differential between the cavity and the hydraulic fluid within the compensator and hydraulic line is fixed, and the pressure differential is close to zero or zero in a specific example. Examples of compensators are a bladder made of an appropriate flexible material or a piston.

The pressurised hydraulic lines are connected to a regulator before being coupled to the tool for driving the operation of the tool. The hydraulic control system for driving the operation of the tool further includes a ventilation tool for releasing the hydraulic pressure at the tool. The ventilation tool is provided in an area with lower pressure than the hydraulic pressure of the system such that pressure can be released, for example an area above the annular of the blow-out preventer.

Further, a flowmeter may be provided before the running tool. The flowmeter will indicate how much fluid has passed the hydraulic line towards to the running tool, and from those data an operator or a control system can determine how far a moving part of the running tool has traveled as a result of the hydraulic flow.

Using a blow-out preventer (BOP) cavity to provide pressurised fluid instead of a hydraulic pressure unit (HPU) on a rig at the sea surface together with an umbilical reduces complexity and costs. Instead of bringing hydraulic pressure from the surface down to the wellhead, the present system is based on using the BOP to create the pressure. In addition, the water depth will have no direct impact on the way the system works because the hydraulic pressure is only determined by the BOP cavity pressure.

Communication with the hydraulic pressure system can take place through the BOP or via a communication cable from a drill floor.

Figure 1:
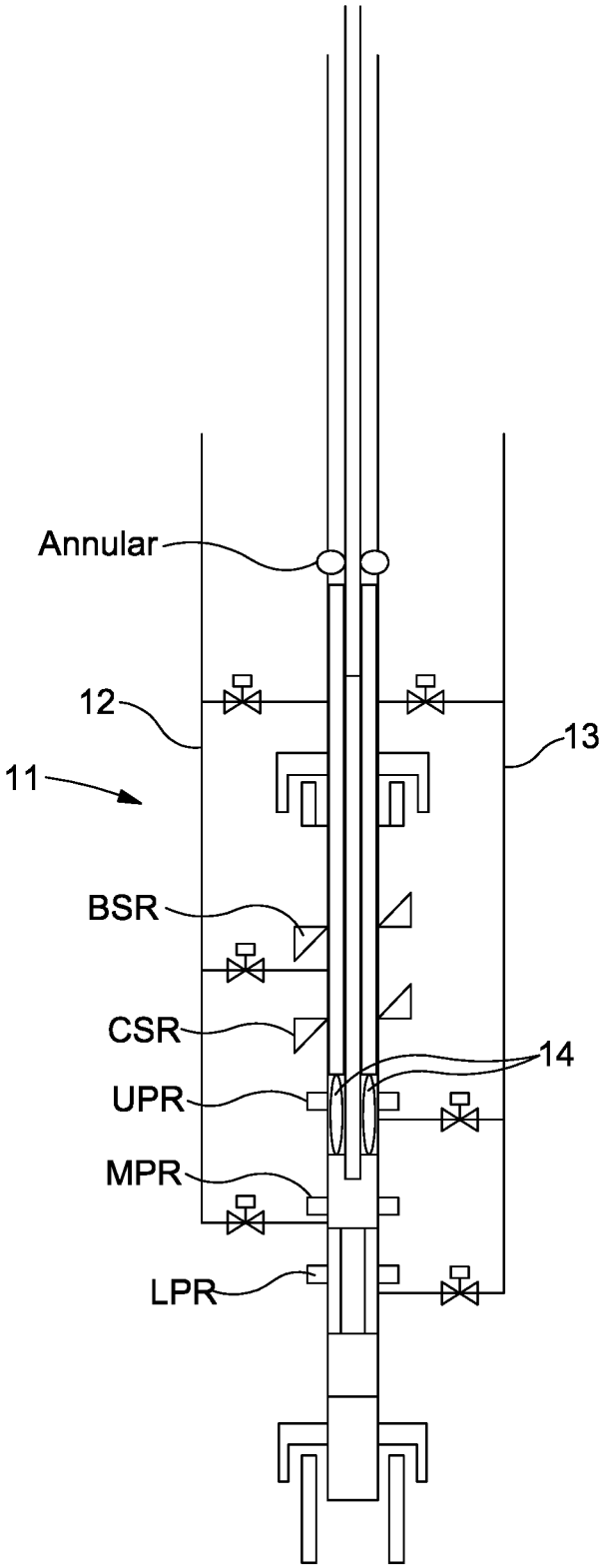
FIG. 1 illustrates a wellhead system including a hydraulic control system.

A particular embodiment is illustrated in FIG. 1. A BOP 11 is illustrated which includes several standard sealing elements: a blind shear ram (BSR), a casing shear ram (CSR), an upper pipe ram (UPR), middle pipe ram (MPR) and lower pipe ram (LPR). Further illustrated are a choke line (12) and a kill line (13).

A bladder 14 is provided within a cavity and the bladder acts as a compensator for driving the running tool. The bladder is provided in the cavity between the MPR and the annular, but other cavities may also be used.

Figure 2:
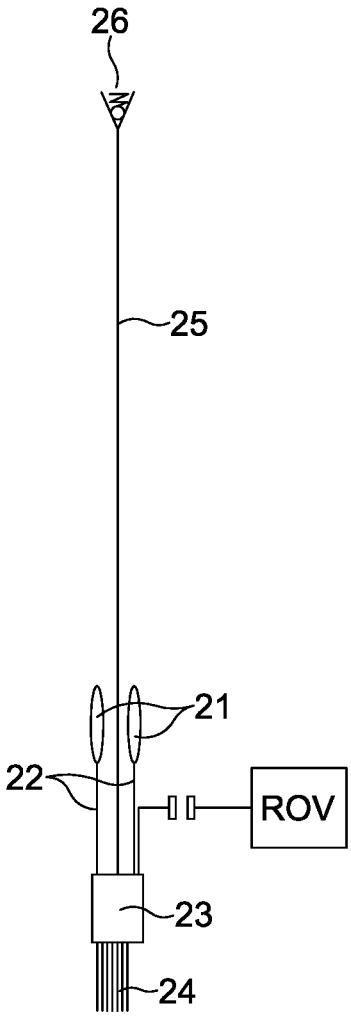
FIG. 2 illustrates the hydraulic control system.

The hydraulic pressure system is illustrated in FIG. 2 in which the rest of the BOP is omitted for clarity. Bladders 21 are illustrated which are the same as bladders 14 in FIG. 1. The bladders are connected to a control unit 23 by hydraulic lines 22. Control unit 23 has several hydraulic outlets 24 towards the running tool for controlling different functions of the running tool. When intervention is required, a remotely operated vehicle (ROV) can optionally be used to access the device by way of suitable connections. Instead of an ROV or in addition to an ROV, however, it is also possible to use a communication cable from the surface towards the control unit. The communication cable can run through a slick part of the upper annular. A hydraulic release line 25 extends upwards towards a ventilation tool 26. In this example, the ventilation tool is provided above the annular of the BOP.

Figure 3:
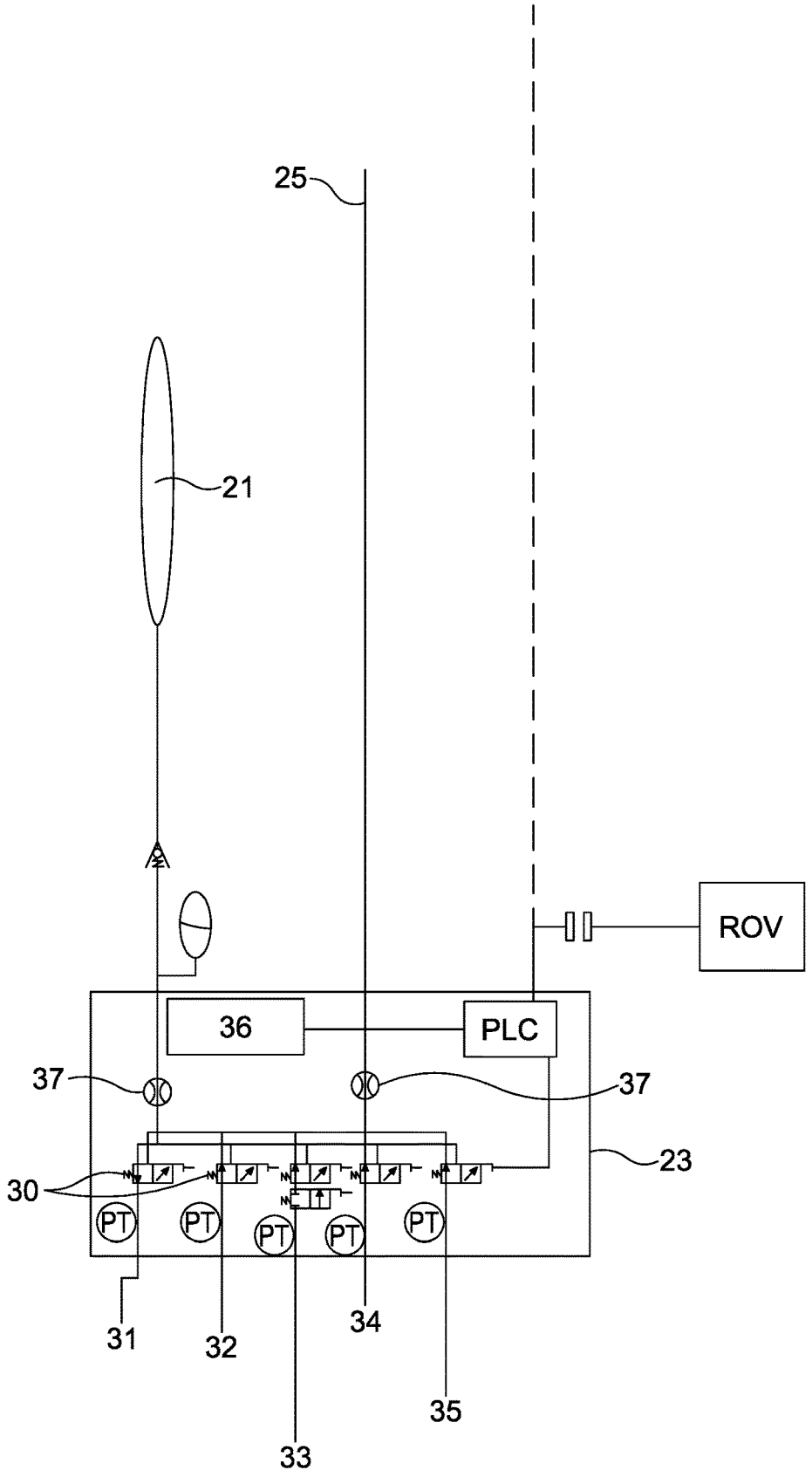
FIG. 3 illustrates the hydraulic control system in more detail.

FIG. 3 illustrates more detail of the control unit of the hydraulic control device. A bladder 21 and hydraulic release line 25 are provided as in FIG. 2. Controller 23 is used to distribute and control the hydraulic pressure outlets towards the running tool. The outputs are controlled by hydraulic control valves 30. The outputs of the illustrated embodiment are connected to the running tool functions as follows: running tool latch (31), running tool unlock (32), tubing hanger unlock (33), tubing hanger lock (34), and tubing hanger verification (35). Further, a programmable logic controller (PLC) and/or a battery (36) are provided. Flowmeters 37 are provided which can be used to determine the traveled distance of tubing hanger components or tubing hanger running tools. Signals may be provided from the surface to the control unit by way of a control cable, or alternatively an ROV can be used to instruct the control unit.

The hydraulic output of the hydraulic pressure system illustrated in FIGS. 1 to 3 can be used for any relevant device which operates based on hydraulic pressure. Other examples are as follows. An hydraulic wellhead cleaning tool which may be used for cleaning the wellhead seal surface. Hydraulic activation tools for the BOP itself could be based on this hydraulic pressure system, but it should be noted that in the configuration of FIG. 1 the pressure in the illustrated cavity will drop if one of the shear rams is activated.

Figure 4:
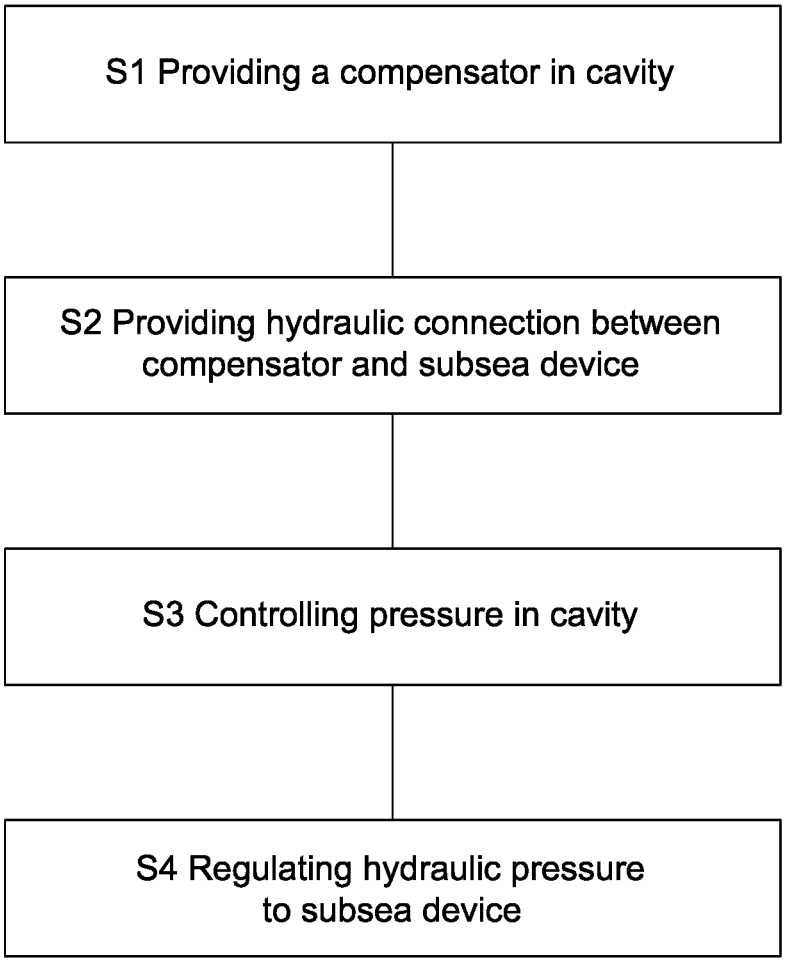
FIG. 4 is a flow diagram of a method.

A method is illustrated in FIG. 4, comprising the steps of: providing a compensator in a cavity (S1), providing a hydraulic connection between the compensator and a subsea device (S2), controlling the pressure in the cavity (S3) and regulating the hydraulic pressure to the subsea device (S4).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A system for hydraulically controlling a subsea device, the system comprising:

a compensator comprising a flexible material and being provided within a cavity of a well system, wherein the compensator is in pressure communication with the cavity to which the compensator is disposed, and is not in fluid communication with the cavity, a hydraulic connection between the compensator and the subsea device, a pressure regulator arranged to regulate the hydraulic pressure provided to the subsea device, a ventilation tool for releasing pressure at the subsea device.

2. The system according to claim 1, further comprising a second pressure regulator for controlling the pressure in the cavity.

3. The system according to claim 1, wherein the cavity is provided within a blow-out preventer.

4. The system according to claim 1, wherein the cavity is provided within an annulus above a blow-out preventer.

5. The system according to claim 2, wherein the second pressure regulator is provided below a choke line.

6. The system according to claim 1, wherein the compensator is a bladder.

7. The system according to claim 1, wherein the subsea device is a tubing hanger running tool or a tubing hanger.

8. The system according to claim 1, further comprising a flowmeter for determining the amount of fluid which has passed towards the subsea device.

9. The system according to claim 1, wherein the subsea device is a wellhead cleaning tool.

10. The system according to claim 1, wherein the cavity is an annulus above a tubing hanger.

11. The system according to claim 1, wherein the cavity is provided below an upper annular valve.

12. A method of hydraulically controlling a subsea device, the method comprising:

providing a compensator comprising a flexible material within a cavity of a well system, wherein the compensator is in pressure communication with the cavity to which the compensator is disposed, and is not in fluid communication with the cavity, providing a hydraulic connection between the compensator and the subsea device, controlling the pressure within the cavity, regulating hydraulic pressure from the compensator to the subsea device.

13. The method according to claim 12, wherein the cavity is provided within a blow-out preventer.

14. The method according to claim 12, wherein controlling the pressure within the cavity comprises closing a valve.

15. The method according to claim 12, wherein regulating hydraulic pressure from the compensator to the subsea device comprises controlling the pressure to a plurality of outlets towards the subsea device and wherein each of the plurality of outlets controls a function of the subsea device.

16. The method according to claim 12, further comprising measuring the amount of fluid which flows towards the subsea device.

* * * * *